United States Patent [19]

Mondini

[11] 4,384,388

[45] May 24, 1983

[54] METHOD FOR CONTROLLING THE WORKING CONDITIONS IN A PROCESSING MACHINE OF THE STAPLE FIBER SPINNING PLANT AND APPARATUS FOR IMPLEMENTING THE METHOD

[75] Inventor: Giancarlo Mondini, Winterthur, Switzerland

[73] Assignee: Rieter Machine Works, Ltd., Winterthur, Switzerland

[21] Appl. No.: 179,291

[22] PCT Filed: Apr. 23, 1979

[86] PCT No.: PCT/EP79/00028

§ 371 Date: Dec. 11, 1979

§ 102(e) Date: Dec. 11, 1979

[87] PCT Pub. No.: WO79/00983

PCT Pub. Date: Nov. 29, 1979

[30] Foreign Application Priority Data

Apr. 25, 1978 [CH] Switzerland ..... 4442/78

[51] Int. Cl.[3] ..... D01G 15/12

[52] U.S. Cl. ..... 19/99; 19/105; 19/106 R; 19/300

[58] Field of Search ..... 19/105, 98, 112, 99, 19/106 R, 240, 300

[56] References Cited

U.S. PATENT DOCUMENTS 1,550,391 8/1925 Platt ..... 19/105

4,100,650 7/1978 Wirth et al. ..... 19/105

FOREIGN PATENT DOCUMENTS 1542878 9/1968 France .

*Primary Examiner*—Louis Rimrodt

*Attorney, Agent, or Firm*—Kenyon & Kenyon

[57] ABSTRACT

The working conditions between two rotating cylinders (4,5), which are provided with a point clothing (9,19) and are processing or mutually transferring a fibre web, of a processing machine of the staple fibre spinning plant are always maintained on a predetermined value by adapting the distance between the surfaces of the two cylinders (4,5). For this purpose moving means (21) are used, which permit very precise setting of the distance between the rotational axes (8,14) of the two cylinders (4,5), and which are controlled by control means (22). To the control means (22) the measuring signal of a characteristic directly connected with the diameter of one of the cylinders (4 or 5), as scanned by a measuring element (25), is transmitted, and the control means (22) control the moving elements (21) in function of this characteristic. Thus complete elimination of the disturbing influences of the centrifugal force and of the increase in temperature of the cylinders onto the working conditions is achieved.

16 Claims, 6 Drawing Figures

Figure 1:
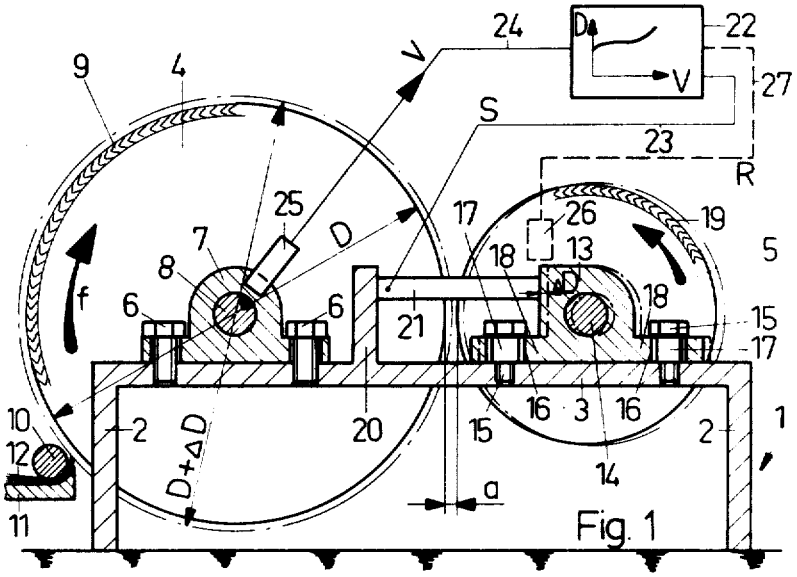

METHOD FOR CONTROLLING THE WORKING CONDITIONS IN A PROCESSING MACHINE OF THE STAPLE FIBER SPINNING PLANT AND APPARATUS FOR IMPLEMENTING THE METHOD

The present invention concerns a method of controlling the working conditions between two rotating cylinders, which are equipped with a point clothing, and on the cylindrical surface of which a fiber web is processed or mutually transferred, and which cooperate at a small mutual distance between the cylindrical surfaces at the web processing or web transfer points, of a processing machine of the staple fiber spinning plant, and apparatus for implementing the method.

In staple fiber spinning, particularly in the first stages of the process leading to the yarn formation, the problem arises to bring progressive order into the random arrangement of fibers as it prevails in the bales and at the same time to eliminate the impurities contained in the raw material. This problem is solved using fiber processing machines of the type described above, in which the fibers in the form of a thin fiber web are transferred from a first cylinder equipped with a clothing to a second cylinder which also is equipped with a clothing, or in which the fibers of the fiber web are subject to a combing process between the surfaces of two cylinders equipped with a clothing, which move relative to each other, by the points of the clothing without transfer of fibers from one cylinder to the other. Typical examples of such fiber processing stages are found e.g. on the card, where e.g. between the taker-in or licker-in roll and the main cylinder, or between the main cylinder and the doffer respectively, an almost complete transfer of the fibers from one cylinder to the other is effected, whereas between the main cylinder and the flats a combing action, also called carding action is effected without transfer of the fibers. The transfer of the fibers between two cylinders as well as the carding action depend substantially on the working conditions between the two cylinders involved, the distance between the cylinder surfaces at the transfer point, or at the processing point respectively, exerting a decisive influence (besides other factors, such as e.g. the type of the clothing points or the surface speed). Experience has shown that the transfer of the fibers as well as the carding action is better, the smaller the distance defined above is. Thus one tries to keep said distance as narrow as possible, namely in the range of 1/10 mm.

The term cylinder in this context is understood to designate a substantially cylindrical surface equipped with a point clothing, independently of whether said surface is convex or concave, and whether the cylindrical surface extends over the full circle or over only a part thereof, and whether the surface consists of one rigid body or of a number of elements connected in chain-like fashion, such as the group of flats of a revolving flat card.

The term distance between two cylinders equipped with a point clothing in this context is understood to designate always the distance or clearance at the closest point between the points of the clothing, which can be determined e.g. by inserting a feeler gauge between the clothings.

For increasing the production rate of the processing machines in question two approaches were chosen: on one hand, the rotational speed of the processing elements was increased, and on the other hand, the dimensions of the cylinders of the machine, namely the diameter as well as the working width, were increased. Fulfillment of both measures, however, implies compromises concerning the quality of the working conditions of the machine, as caused by the increased rotational speed and by the increased dimensions the undesirable deformation of the cylinders, i.e. their bulging, caused by the centrifugal force, is increased progressively. A further influence connected with the increase of the production rate and, thus of the carding action directly, is the influence of the heat expansion of the cylinders involved, the present trend of suppressing to a large extent the air exchange between the cylinders and the surrounding room, for preventing dust emissions, impeding the natural cooling of the working elements. The temperature of the cylinders involved thus increases over a period of operating time until an equilibrium temperature is reached, under which circumstances this increase in temperature, which can reach values of about 30° C., causes a change in the dimensions of the cylinders and in particular an increase of their diameters.

The influence of the centrifugal force, as well as the influence of the increase in temperature do not become effective immediately upon the start-up of the machine, but become effective only after a certain time delay, which regarding the influence of the centrifugal force, as a minimum, extends over the acceleration period of the elements involved in the case of the card e.g. of the main cylinder. The influence of the increase of temperature, according to experience extends over much longer periods of operating time, until an equilibrium temperature is established, which can extend over several hours.

Using known machines according to the state of the art, e.g. cards as presently in practical use, the distance between the working elements, i.e. between two cooperating cylinders each, thus is to be set before the start-up larger than prevailing under normal operating conditions, taking into account the deformations, i.e. the bulging, of the cylinders under the influence of the centrifugal force and the temperature effect. Thus the distance between the cooperating cylinders is too large during the whole start-up phase and correspondingly during the slow-down phase, such that the working conditions between the cylinders are unfavourable. This causes either imperfect transfer of the fiber web from one cylinder to the other or causes unsufficient card action. The machine working during the start-up phase, and during the slow-down phase respectively, under unfavourable conditions thus produces a qualitatively inferior product during this time. In extreme cases, i.e. if the fiber web transfer from one cylinder to the other is rendered unreliable or even impossible due to the too large distances, operating of the machine as such may be endangered. As the distances between the working elements are to be set before the machine is started up, one is tempted to choose larger distances than required, in order to safely avoid any danger of clothing contact or interference during operation. The result is that the machines quite often are operated at too large distances, i.e. under unfavourable setting conditions.

It has been tried before, to counter the problems described by limiting the cylinder deformations by design measures. This, however, results in complicated and weighty designs, which increase construction costs of the machine and can not solve the problems entirely.

The above description holds true correspondingly for all other machines used in the staple fiber spinning plant, in which two cylinders of the above mentioned type cooperate at small mutual distances, e.g. certain opening machines, such as garnets, roller carding engines, etc., are to be mentioned.

It thus is the object of the present invention, to eliminate the disadvantages of the known processing machines of the staple fiber spinning plant of the above mentioned type and to propose a method of controlling the working conditions between two rotating cylinders, which are equipped with a point clothing, and on the cylindrical surface of which a fiber web is processed or mutually transferred, and which cooperate at a small mutual distance at the web processing or transfer points, using which it is possible to ensure optimum working conditions at all times, particularly also during the start-up phase and the slow-down phase of the machine operation. The apparatus for implementing the method is to be simple and reliable in operation and is to be economically feasible in manufacture, and above all is not to cause any complication and price increase of the machine.

This object, according to the invention, is achieved by a method of controlling the working conditions in a processing machine of the staple fiber spinning plant of the type initially mentioned, in that a characteristic directly connected with the dimensions of at least one of the cylinders is continuously or cyclically scanned and in that the distance between the cylindrical surfaces of both cylinders at the web processing or transfer points is maintained at a predetermined value in function of the characteristic scanned.

In this method the characteristic scanned, according to the invention can be influenced by the centrifugal force generated by the rotation of the cylinder and/or by the thermically caused change in the dimension of the cylinder.

An advantageous apparatus for implementing the inventive method, with two rotating cylinders, which are equipped with a point clothing, on the cylindrical surface of which a fiber web is mutually transferred, and which cooperate at a small mutual distance, of a processing machine of the staple fiber spinning plant, is characterized in that a measuring element for continuously or cyclically scanning a characteristic directly connected with the dimensions of at least one of the two cylinders is provided, that the support members of at least one of the cylinders are arranged movable mutually parallel in a plane which is substantially parallel to the plane containing the axes of both cylinders, and that moving elements for the movable support members of the cylinder and control means are provided, which control the moving elements in function of the characteristic scanned.

Another advantageous embodiment of the apparatus for implementing the method with two rotating cylinders, which are equipped with a point clothing, and on the cylindrical surface of which a fiber web is processed, and which cooperate at a small mutual distance, of a processing machine of the staple fiber spinning plant is characterized in that two cylinders are arranged substantially coaxial, and that a measuring element for continuously or cyclically scanning a characteristic directly connected with the dimensions of one of the two cylinders is provided, and that moving elements using which the diameter of at least one cylinder can be changed and which are controlled by control means in function of the characteristic scanned, are provided.

The inventive apparatus advantageously is applied to a card (which can be designed as a roller card or as a revolving flat card). Furthermore the control means can be pre-programmable according to the direct connection or relation between the dimensions of the cylinder and the characteristic scanned. The moving elements can consist of a distance-changing mechanical connection, such as e.g. of a driven threaded spindle or of a metal rod, the thermical length expansion of which is utilized.

Figure 2A:
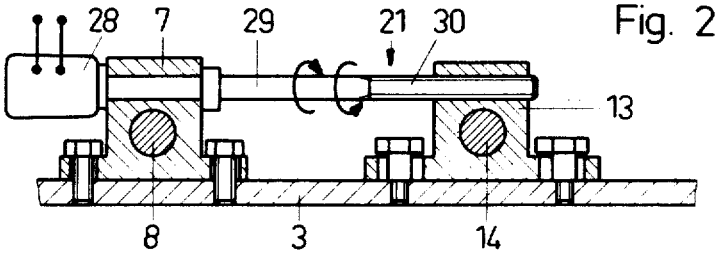
Figure 2B:
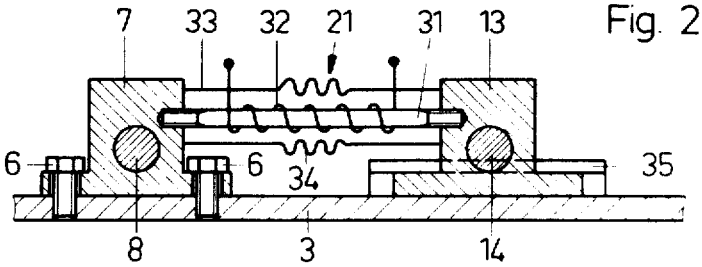
Figure 2C:
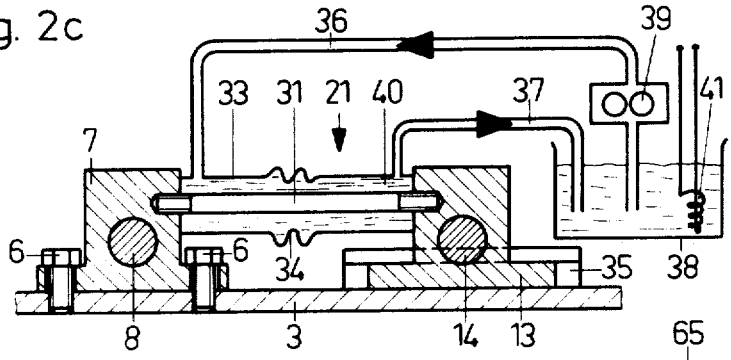
Figure 3:
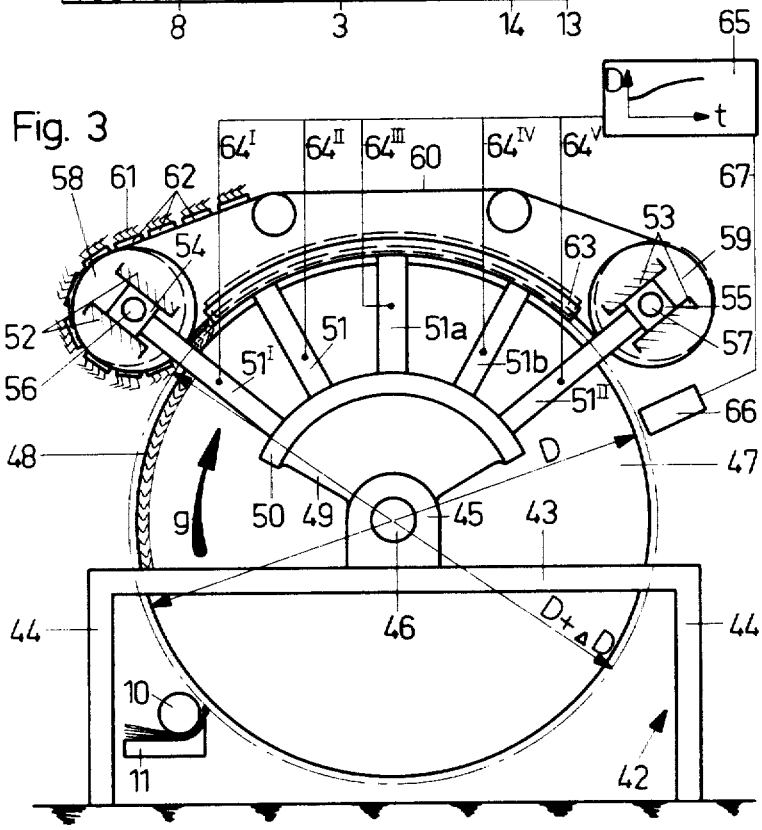
Figure 4:
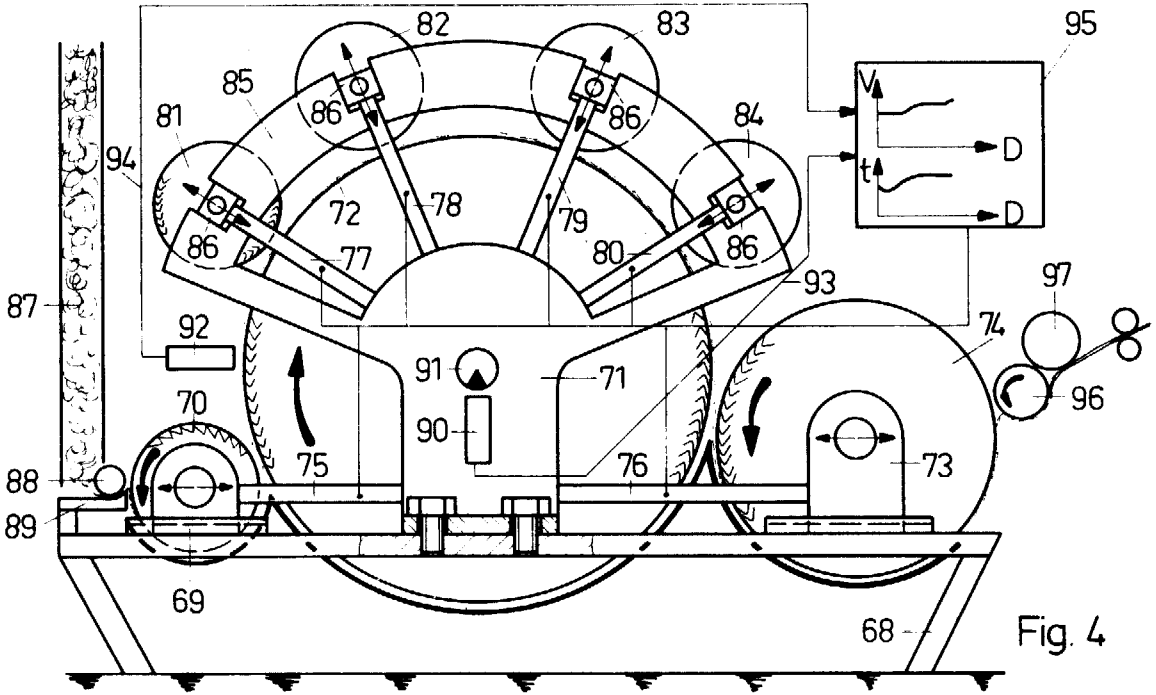

The invention is described in the following in more detail with reference to illustrated design examples. It is shown in:

These and other objects and advantages of the invention will become more apparent from the following detailed description taken in conjunction with the accompanying drawings wherein:

FIG. 1 illustrates a simplified, schematic side view of the inventive apparatus, FIGS. 2*a* through 2*c* illustrates a detail each of a moving element as it can be applied in an apparatus according to FIG. 1, FIG. 3 illustrates a simplified, schematic side view of an alternative embodiment of the inventive apparatus, FIG. 4 illustrates a schematic view of a card on which the inventive apparatus is applied on a plurality of working elements.

In FIG. 1 the stationary frame 1 of a processing machine of the staple fiber spinning plant, is designed as a frame with four support elements 2 (two only being shown) and with two horizontal longitudinal side members 3 (one only being shown). The two longitudinal side members 3 and the support elements 2 are interconnected by crossmembers (not shown) to form a stable rigid support frame for two rotating cylinders 4 and 5, which are equipped with a point clothing and which cooperate at a small mutual distance a.

The cylinder 4 is supported rotatable about its axis 8 and unshiftable with respect to the room in two support members 7 (one of which only is shown in FIG. 1), which are rigidly screwed onto the longitudinal side members 3 by screws 6, and is driven by means not shown and rotated clockwise (in the direction of arrow f).

The cylinder 4 supports a point clothing 9 on its cylindrical surface, using which clothing 9 fibers are plucked from a fiber layer 12 presented by a rotating feeder roll 10 and a feeder plate 11, in such manner that on the surface of the cylinder 4 a thin, a more or less coherent fiber web (not shown) is formed, which web is caught by the surface of the cylinder 4 and is carried on. The point clothing 9 indicated in FIG. 1 is shown e.g. as a so-called flexible clothing consisting of steel wire points bent in knee-form. Any type of point clothing, however, such as e.g. a rigid clothing consisting of a profiled wire with points or a saw-tooth clothing, can be applied.

The cylinder 5 also is supported rotatable about its axis 14 in two support members 13 (one only being shown) on the longitudinal side members 3 of the frame 1. The support members 13, however, are not screwed onto the longitudinal side members 3, but they are guided by two stud screws 15 in such manner that they are movable parallel to the axis 14 over a small length of the order of 1 to 2 mm. For this purpose slot openings 16 for the protruding screws 15 are provided in the support members 13, which openings 16 permit precise lateral guidance of the support members 13 while their longitudinal movability is ensured. The stud 17 of the stud screws 15 exceeds in height the fixing extensions 18 of the support members 13 by somewhat, in such manner that the screws 15 are not clamping the support members 13.

By parallel movement of the support members 13 in the slot openings 16 thus the distance between the cylindrical surfaces of the cylinders 4 and 5 can be varied.

The cylinder 5 on its cylindrical surface also is provided with a point clothing 9, which also in this case is indicated as a flexible steel wire clothing.

As an example of two cylinders, which mutually transfer the fiber web, the taker-in or licker-in roll and the main cylinder are mentioned herein. As an example of two cylinders which are arranged in the same manner as the ones shown in FIG. 1, which however do not mutually transfer the fiber web, but extend and orient the fibers of the fiber web under the action of the point clothing in the sense of a carding action (which herein is designated as processing of the fiber web), e.g. the main cylinder and the worker roll of a roller card, are mentioned herein.

In the transfer of the fiber web from one cylinder to the other, as well as in processing (carding action) of the fiber web between two cylinders, the distance a between the cylindrical surfaces of both cylinders exerts a decisive influence besides other parameters such as e.g. the surface speed of both cylinders and the type of the point clothing. Good working conditions between the cylinders thus can be ensured only, if the distance a is maintained within precise and very close tolerances. In this arrangement the optimum value of the distance a, for cylinder diameters ranging from about 0.20 meters to 1.5 meters and cylinder lengths of up to about 2 meters, is in the range of about 0.05 millimeters $<a<0.3$ millimeters, where the lower limit of the distance a is not technologically implied, but is to be respected merely for avoiding mutual contact or interference of the points of the clothing of both cylinders. Otherwise the danger of fire and of mechanical damage to the expensive point clothings is consisting. The distance a thus, in comparison to the dimensions of the cylinders, is extremely small.

The increase of the diameter caused by the increase of the temperature of the cylinder is, as established by studies, of the order of about 0.08 millimeters per 10° C. temperature increase, which entirely corresponds to the order of magnitude of the optimum value of the distance a. Similar deformations are caused by the influence of the centrifugal force.

In FIG. 1 the diameter of the cylinder 4 in its non-deformed state (i.e. practically before the start-up of the machine and at room temperature) is designated D, whereas $D+\Delta D$ designates the diameter (indicated with dash-dotted lines) of the cylinder in its deformed state under the influence of the centrifugal force and/or the temperature effect.

Due to the increase $\Delta D$ of the diameter now the distance a between the cylinder surfaces in their non-deformed state would be reduced by $\Delta D/2$, under the condition that the cylinder 5 undergoes no deformation; an assumption which in many cases is a good approximation. If the distance a had been chosen optimum while the cylinder 4 is in its un-deformed state, the distance $a-\Delta D/2$, prevailing while the cylinder 4 is in its deformed state, would be below the permissible limit, which would be very dangerous. According to the invention occurrence of this danger is prevented. This is achieved by the apparatus according to FIG. 1 in that the two support members 13 of the cylinder 5 are removed mutually from the fixed supports 7 of the cylinder 4 over the corresponding length $\Delta D/2$ in such manner that this movement is effected in a plane which is substantially parallel to the plane containing the axes 8 and 14. For this purpose the machine frame 1, on its side members 3, is provided with a fixed stop 20 each for moving elements 21 (shifting elements), which are placed between the fixed stop 20 and the support member 13, the design of which moving elements 21 is described in more detail later on. The moving elements are able to determine the position of the support member 13 corresponding to them with respect to the fixed support member 7. Control of the moving elements 21 according to the invention is effected based on control means 22 via the control circuit 23, via which the control means 22 transmit a control signal (e.g. an electrical signal) to the moving elements.

The control means 22 themselves are supplied via a circuit 24 with a measuring signal V (e.g. an electrical measuring signal), which is scanned by a suitable measuring element 25 working cyclically or continuously, and which corresponds to a characteristic directly connected with the dimensions of at least one of the two cylinders. In the design example illustrated in FIG. 1 e.g. the measuring element 25 is an instrument measuring the rotational speed, the signal V of which is proportional to the rotational speed (number of revolutions per time unit) of the shaft 8 of the cylinder 4. The control means 22 furthermore are preprogrammed in this design example according to the connection or relation between the dimensions of the cylinder, i.e. of its diameter, and the characteristic scanned, i.e. the rotational speed of the cylinder in this design example. Thus the control means 22 are able, based on the measuring signal V, which corresponds to the rotational speed, to determine the corresponding cylinder diameter $D+\Delta D$ and to transmit to the moving elements 21 a control signal S, which causes the moving elements to effect a correction of the distance between the axes 8 and 14 of the cylinders over the length $\Delta D/2$ in such manner that the distance a is maintained constant. If the dimensional change of the cylinder 4 occurs gradually, e.g. caused by the centrifugal force during the acceleration of the cylinder, the corresponding correction of the distance between the axes 8 and 14 by the moving elements 21 also is effected, in such manner that the distance a is maintained constant over the whole start-up phase. The apparatus illustrated in FIG. 1 thus permits e.g. to eliminate completely in an arrangement of cylinders or rolls of the above mentioned type the influence of the centrifugal force onto the working conditions between the two cylinders 4 and 5.

In the apparatus according to FIG. 1 it is not indispensible, however, to measure the rotational speed of the cylinder 4; also e.g. the distance a between the cylindrical surfaces or the diameter of the cylinder 4 could as well be measured by a corresponding measuring instrument (e.g. by a contact-free feeler gauge, or by a photo-optical measuring instrument—not shown) directly, in which case the control means 22 no longer would have to be preprogrammed according to the connection or relation between the dimensions of the cylinder and the characteristic scanned, as in this case the control signal S simply is to be directly proportional to the characteristic scanned. Measuring the rotational speed of the cylinder, however, proves to be simpler and more precise than direct measurement of the relatively small changes caused by the centrifugal force in the distance a or of the deformation of the cylinder diameter, under which circumstances the indirect approach via the connection or relation of rotational speed/diameter change has proven advantageous.

In analogue manner the adaption of the distance a between the axes 8 and 14 of the cylinders 4 and 5 can be effected for the purpose of maintaining the predetermined values of the distance a, if the increase in the diameters is caused by an increase in temperature rather than by the centrifugal force. In this case a measuring element is used which either measures the diameter itself of the cylinder 4 or measures a characteristic directly connected with the diameter of the cylinder (such as e.g. the surface temperature of the cylinder 4) and which transmits a corresponding measuring signal V to the control means 22. The whole control arrangement, however, functions exactly in the same manner as in the case described before. Also in this case the distance a is maintained on a predetermined value in spite of an increase in temperature of the cylinder 4.

Apparatuses also can be considered, which scan and correct the influence e.g. of the centrifugal force as well as the influence of e.g. the increase in temperature onto the distance a, in which case the control means can be pre-programmed according to the direct connection or relation between the cylinder diameter and the rotational speed of the cylinder (influence of the centrifugal force) as well as between the cylinder surface temperature and the cylinder diameter.

Furthermore it can prove advantageous to control the movement of the support members 13 using a displacement measuring instrument 26, which transmits a feed-back signal R to the control means 22 via the circuit 27. Using a control arrangement of this type the function of the moving elements 21 can be kept under control constantly, for eliminating any danger of contact between the clothings of the cylinders 4 and 5.

The function of the control means and the control circuits incorporating the measuring element 25, control means 22, moving elements 21 and, if desired, displacement measuring instruments 26, as shown and mentioned in this context, are well known in control technology and thus are not described in more detail herein.

In FIGS. 2*a* through 2*c* several alternative design examples of preferentially applied moving elements are shown.

In FIG. 2*a* a threaded spindle 29 driven by a motor 28 is shown as a moving element 21. The threaded spindle 29 in this arrangement e.g. is rotatably supported axially not shiftable in the fixed support 7 of the axis 8 of the cylinder 4, whereas the other end provided with a thread 30 is screwed into the movable support member 13 of the axis 14 of the cylinder 5. By rotating the threaded spindle 29 in one direction or the opposite direction the distance between the axes 8 and 14 thus can be increased, or be reduced respectively.

In FIG. 2*b* an alternative design example of the moving elements 21 is shown, in which for moving the support 13 the thermical expansion of a metal rod is utilized. For this purpose a metal rod 31 is rigidly anchored, e.g. using thread connections, in the support members 7 and 13. The heat supply required for thermically expanding the metal rod 31 in the design example according to FIG. 2*b* is generated by an electrical resistor 32 directly wrapped around the rod 31, the electric current supply of which is controlled by the control means 22 (FIG. 1) in a manner not shown in the drawing. The rod 31 is surrounded by a protectivve cover 33, which e.g. owing to its folds or undulations 34 is axially expandable, such that it can follow the length variations of the rod 31 practically without taking up forces. In FIG. 2*b* furthermore another design example, as differing from the one shown in FIGS. 1 and 2*a*, is shown of the movable mounting of the support 13 on the side member 3, which here is effected using prismatic guides 35 known as such.

In FIG. 2*c* a further alternative design example of the moving elements 21 according to FIG. 2*b* is shown, in which arrangement the heat supply is effected using a fluid. For this purpose the protective cover 33 is connected to a fluid supply duct 36 and to a fluid exit duct 37, which ducts merge into a fluid recipient 38. In the fluid supply duct 36 a pump 39 is inserted using which the fluid from the recipient 38 can be supplied under pressure into the chamber 40 formed about the metal rod 31 by the protective cover.

The fluid in the recipient 38 is heated by a heating device 41 (e.g. an electrical resistance heating device) to a certain temperature determined by the control means 22 (FIG. 1) in such manner that the rod 31 according to correction $\Delta D/2$ of the distance between the axes 8 and 14 to be effected can expand more or less.

The control means shown in FIG. 2*c* are particularly suitable where a plurality of moving means (as described with reference to the design examples shown in FIGS. 3 and 4) are to be controlled from common control means. For the moving elements according to FIG. 2*c* a liquid (such as e.g. water, or oil) as well as a gas (e.g. air) can be used as a fluid, in which arrangement a system with circulation of heated air has proven particularly suitable.

In FIG. 3 an alternative design example of the apparatus is shown, which differs from the one shown in FIG. 1 in that the two cylinders equipped with a point clothing here are arranged substantially coaxially, in which arrangement one of the cylinders, namely the outer cylinder, does not extend over the whole circumference of the second cylinder. Such cylinder arrangements are used mainly processing the fiber web in a carding action and are found in use e.g. on the revolving flat card. As differing from the arrangement shown in FIG. 1, in which both cylinders 4 and 5 show a convex surface, in this arrangement one cylinder shows a convex surface whereas the second cylinder shows a concentric concave surface of almost the same diameter.

The problem concerning the mutual distance between the surfaces provided with a point clothing of two cooperating cylinders, as described above, prevails also in the arrangement according to FIG. 3 correspondingly. The only difference is seen in that by adapting the distance between the cylindrical surfaces of both cylinders in the arrangement according to FIG. 3 no longer, as in the arrangement described with reference to FIG. 1, is effected by adapting the distance between the rotational axes of the two cylinders, but e.g. is effected by adapting the diameter of at least one of the cylinders, such as clarified by the following detailed description of the arrangement according to FIG. 3.

A machine frame 42 consists of two longitudinal side members 43 (one only being shown), four support elements 44 (two only being shown) and connecting crossmembers (not shown). On each longitudinal side member 43 a support membber 45 is rigidly mounted. These support members 45 support the axis 46 of a rotatably supported cylinder 47, which here is imagined as a main cylinder of a card which is not shown in more detail. The cylinder 47 is rotated about its axis 46 (arrow g) by means not shown. The cylinder 47 on its surface is provided with a point clothing 48.

The support 45 in its upper part supports a segment 50 which is rigidly connected with the support member via an intermediate member 49, on which segment 50 a number of moving elements $51^{I}$, $51^{II}$ 51, 51*a* and 51*b*, which also act as support elements, are arranged radially. The moving elements 51,51*a* and 51*b* are designed e.g. as the elements described with reference to FIGS. 2*a* through 2*c*.

The supporting and moving elements $51^{I}$ and $51^{II}$ each support a body 54, and 55 respectively, sliding in two radial guide devices 52 and 53 respectively, in which the axes 56, and 57 respectively, of a flat chain deflecting roll 58, and 59 respectively, are rotatably supported. By the length expansion of the moving elements $51^{I}$ and $51^{II}$ respectively, the radial position of the deflecting rolls 58, and 59 respectively, can be changed with respect to the surface of the cylinder 47. About the two rolls 58 and 59 revolves a so-called flat chain 60, consisting of a row of flat rods 62, which are arranged mutually parallel across the machine and are provided with a point clothing 61, and which at both their ends each are interconnected to form a chain.

The flat chain 60 in the zone between the two deflecting rolls 58 and 69 is guided above the cylinder surface on each side by a guide arc 63 in such manner that between the points of the clothing of the cylinder 47 and the ones of the flats a certain distance is precisely maintained. For this purpose the guide arcs 63 are supported by three moving elements 51, 51*a* and 51*b*. One of the deflecting rolls 58, or 59 respectively, is set into rotation by means not shown in such manner that the whole flat chain moves slowly, the leg of the flat chain facing the surface of the cylinder 47 being guided by the guide arc 63 in such manner that it moves on a circular path about the center of the axis 46. The moving elements $51^{I}$ and $51^{II}$ for positioning the two deflecting rolls 58 and 59 and the moving elements 51, 51*a* and 51*b* for supporting and positioning the guide arc 63 are connected via circuits $64^{I}$ through $64^{V}$ with control means 65, which jointly control all moving elements $51^{I}$,$51^{II}$, 51,51*a* and 51*b*. The control means 65 are connected via a circuit 67 with a temperature gauge 66, which measures the temperature t of the surface of the cylinder 47, and are pre-programmed according to the direct connection or relation between the dimensions of the cylinder 47, e.g. its diameter, and the temperature of its surface.

The operational function of the apparatus according to FIG. 3 is similar to the one of the apparatus described before with reference to FIG. 1. If, e.g. due to an increase in temperature, the diameter of the cylinder 47 increases, this change is detected by the temperature gauge 66 indirectly as a function of the temperature t of the cylinder surface. The signal transmitted via the circuit 67 to the control means 65 is processed there, using the pre-programmed relations, into a signal corresponding to the increase $\Delta D$ of the diameter. Via the circuits $64^{I}$ through $64^{V}$ the moving elements $51^{I}$, $51^{II}$, 51, 51*a* and 51*b* are activated to effect a corresponding correction of $\Delta D/2$, in which process the moving elements $51^{I}$ and $51^{II}$ remove the two rolls 58 and 59 over this correction distance away from the surface of the cylinder 47, whereas the moving elements 51, 51*a* and 51*b* generate the same effect for the leg of the flat chain 60, which cooperates with the cylinder surface by deforming the guide arcs 63 in the sense of an increase of their radii over a correcting distance $\Delta D/2$. Thus the working conditions between the two cylindrical surfaces of the cylinder 47 and of the flat chain 60 remain unchanged.

It furthermore is to be noted, that the manner, in which the fibers, or the fiber web respectively, arrive on the surface of e.g. the cylinder 47, is irrelevant within the scope of the invention; merely as a design example of a feed device of this type again the feed roll 10 with the feed plate 11 was illustrating in FIG. 3 as shown in FIG. 1.

In FIG. 4 a schematic side view of a so-called roller card is shown, in which the inventive method and the apparatus for implementing the method are applied correspondingly in the same way to different pairs of rolls or cylinders.

The card comprises a base frame 68, on which in supports 69 (one only being shown) a taker-in roll or licker-in roll 70, in supports 71 a main cylinder 72, and in supports 73 a doffer cylinder 74 are rotatably supported. The supports 71 of the main cylinder 72 ae rigidly screwed onto the base frame 68, whereas the supports 69 and 73 are slidably guided on the base frame 68 and not fixed thereon. Between the fixed supports 71 and the movable supports 69 and 73 on each side of the machine moving elements 75 and 76 are placed in the manner described before with reference to FIG. 1. On the supports 71, similarly as in the apparatus described with reference to FIG. 3, four radially arranged moving elements 77 through 80 are provided, which support and position the worker rolls 81 through 84. The rolls are guided each in a fixed arc 85 on each side of the card in radially arranged guide slots 86.

The fiber feed on this card is effected in a manner known as such, using a feed chute 87, which feeds to a feed roll 88 with a coordinated feeder plate 89.

The fiber material is taken over in form of a fiber web by the taker-in or licker-in roll 70 at the nip between the feed roll 88 and the feeder plate 89 and is transferred to the main cylinder 72, is carded between the main cylinder 72 and the rolls 81 through 84, and at the other end of the card is transferred to the doffer cylinder 74. Owing to the inventive method and apparatus described herein the working conditions at the processing points, and at the transfer points respectively, between the different pairs of cylinders mentioned constantly can be maintained on their optimum values by adapting the corresponding distances between the pairs of cylinders using the moving means 75 through 80.

In the apparatus shown in FIG. 4 furthermore provision is made that the influence of the rotational speed of the cylinders as well as the influence of the temperature increase are taken into account. For this purpose an instrument 90 measuring the rotational speed of the axis 91 of the main cylinder 72, and a temperature gauge 92, which scans the temperature of the surface of the cylinder 72, are provided. These elements via corresponding circuits 93,94 are connected with the control means 95 for all moving elements 75 through 80, in which arrangement the control means 95 are pre-programmed according to the direct connection or relation between the diameter of the main cylinder 72 and its rotational speed, as well as according to the one between the diameter and the temperature of the sleeve surface of the main cylinder. Both influences thus are taken into account by the control means 95.

The arrangement shown in FIG. 4 for the main cylinder 72 can be applied correspondingly to other cylinders of the card, thus also provision could be made of arranging the doffer rolls 96,97 movable with respect to the doffer cylinder 74 and adjustable using corresponding moving elements.

The inventive method and the apparatus for implementing it permit, in novel and surprisingly advantageous manner, optimization of the working conditions between two corresponding cylinders, which process or mutually transfer a fiber web, during the whole production process, which working conditions are decisive for the quality of e.g. the carding action. The inventive apparatus embodiments are simple in design and reliable in operation, in which embodiments the application of metal rods, the thermical expansion of which is utilized, has proven particularly advantageous as moving elements owing to the absence of any mechanically movable parts. Furthermore, retrofitting of such apparatuses to existing machines in most cases is possible without undue expense or complication.

I claim:

1. A method of maintaining a set distance between the cylindrical surfaces of two rotating cylinders at a web processing point of a processing machine of a staple fiber spinning plant, the cylindrical surfaces being equipped with a point clothing, said method comprising the steps of setting a distance between the cylindrical surfaces of the cylinders during assembly;

thereafter automatically scanning a characteristic directly connected with a change of radial dimensions of at least one of the cylinders during operation; and readjusting said distance in function to the characteristic scanned to automatically maintain said set distance during operation.

2. Method according to claim 1, characterized in that the characteristic scanned is influenced by the centrifugal force generated by the rotation of the cylinder.

3. Method according to claim 1, characterized in that the characteristic scanned is influenced by the thermically generated dimensional change of the cylinder.

4. Method according to claim 1, characterized in that the characteristic scanned is influenced by the centrifugal force as well as by the thermically generated dimensional change of the cylinder.

5. Method according to claim 1, characterized in that the characteristic scanned is the distance between the cylindrical surfaces of the two cylinders at the web processing or transfer point.

6. Method according to claim 1, characterized in that the characteristic scanned is the diameter of the cylinder.

7. Method according to claim 1, characterized in that the characteristic scanned is the temperature of the cylinder.

8. Method according to claim 1, characterized in that the characteristic scanned is the rotational speed of the cylinder.

9. Method according to claim 1, characterized in that the predetermined value of the distance ranges between 0.05 and 0.3 mm.

10. Method according to claim 1, characterized in that the direct connection is the relation of the cylinder diameter in function of the rotational speed of the cylinder.

11. Method according to claim 1, characterized in that the direct connection is the relation of the cylinder diameter in function of the surface temperature of the cylinder.

12. Method according to claim 1, characterized in that the direct connection takes into account the relation of the cylinder diameter in function of the rotational speed of the cylinder as well as the relation of the cylinder diameter in function of the surface temperature of the cylinder.

13. A method of controlling the working conditions between two rotatable cylinders of a staple fiber spinning plant each having a point clothing thereon, said method comprising the steps of mounting the cylinders in spaced apart relation to define a predetermined gap therebetween;

scanning a characteristic directly related to the dimensions of at least one of the cylinders during rotation of the cylinders and emitting a signal in response thereto; and automatically maintaining the gap between the cylinders as a function of the characteristic scanned during rotation of the cylinders.

14. A method as set forth in claim 13 wherein said step of maintaining the gap includes automatically moving one of the cylinders relative to the other of the cylinders.

15. A method as set forth in claim 13 wherein said scanning step is performed continuously.

16. A method as set forth in claim 13 wherein said scanning step is performed cylically.

* * * * *